US008093830B2

(12) United States Patent
Inoue

(10) Patent No.: US 8,093,830 B2
(45) Date of Patent: Jan. 10, 2012

(54) SEMICONDUCTOR LIGHT SOURCE DRIVING APPARATUS AND SEMICONDUCTOR LIGHT SOURCE DRIVING METHOD

(75) Inventor: Shuji Inoue, Okayama (JP)

(73) Assignee: Panasonic Corporation, Osaka (JP)

( * ) Notice: Subject to any disclaimer, the term of this patent is extended or adjusted under 35 U.S.C. 154(b) by 425 days.

(21) Appl. No.: 12/496,472

(22) Filed: Jul. 1, 2009

(65) Prior Publication Data

US 2010/0001659 A1 Jan. 7, 2010

(30) Foreign Application Priority Data

Jul. 3, 2008 (JP) ..... 2008-175070

(51) Int. Cl.
*H05B 37/02* (2006.01)
*G05F 1/00* (2006.01)

(52) U.S. Cl. ..... 315/291; 315/307; 315/308; 315/312

(58) Field of Classification Search ..... 315/291, 315/294, 307, 308, 224, 312, 128
See application file for complete search history.

(56) References Cited

U.S. PATENT DOCUMENTS

| | | | | |
|---|---|---|---|---|
| 7,906,917 | B2 * | 3/2011 | Tripathi et al. | 315/291 |
| 2003/0173910 | A1 * | 9/2003 | Suzuki | 315/291 |

FOREIGN PATENT DOCUMENTS

| | | |
|---|---|---|
| JP | 2006-187187 | 7/2006 |
| JP | 2006-303093 | 11/2006 |
| JP | 2007-042758 | 2/2007 |
| JP | 2007-299711 | 11/2007 |

* cited by examiner

*Primary Examiner* — Daniel D Chang

(74) *Attorney, Agent, or Firm* — Hamre, Schumann, Mueller & Larson, P.C.

(57) ABSTRACT

The semiconductor light source driving apparatus has: a semiconductor light source that is driven by a current; a voltage source that drives the semiconductor light source; an output voltage controlling circuit that controls a drive current value for driving the semiconductor light source by controlling an output voltage of the voltage source; an output current detecting circuit that detects an output current of the semiconductor light source; a current command circuit that specifies a reference value of a drive current which is applied to the semiconductor light source; a current comparing circuit that compares the output current detected by the output current detecting circuit and the reference value specified by the current command section; and an impedance detecting circuit that detects an impedance of the semiconductor light source. The output voltage controlling circuit controls the output voltage of the voltage source based on an output of the current comparing circuit and an output of the impedance detecting circuit.

5 Claims, 11 Drawing Sheets

$(V_F, I_F)$=(0.55V, 0.05A) gm=0.091[A/V]
$(V_F, I_F)$=(0.65V, 0.20A) gm=0.308[A/V]
$(V_F, I_F)$=(0.70V, 0.43A) gm=0.614[A/V]

SEMICONDUCTOR LIGHT SOURCE DRIVING APPARATUS AND SEMICONDUCTOR LIGHT SOURCE DRIVING METHOD

CROSS REFERENCE TO RELATED APPLICATIONS

The disclosure of Japanese Patent Application No. 2008-175070, filed on Jul. 3, 2008, including the specification, drawings and abstract, is incorporated herein by reference in its entirety.

TECHNICAL FIELD

The technical field relates to a semiconductor light source driving apparatus and semiconductor light source driving method that are suitable for display devices.

BACKGROUND ART

Recently, semiconductor light sources are utilized for backlight devices for display devices and other lighting applications. Semiconductor light sources include semiconductor laser diodes (LD's) and light-emitting diodes (LED's). The brightness of light emitted by a semiconductor light source depends on the magnitude of the drive current. Consequently, to allow semiconductor light sources to light on stably, semiconductor light sources are generally driven by a constant current (i.e. constant-current control). This constant-current control makes it possible to control the current applied to semiconductor light sources to be constant against various changes during the control (such as fluctuations in the power supply voltage and fluctuations in load).

FIG. 1 is a block diagram showing a configuration of a conventional semiconductor light source driving apparatus that is generally used to perform a constant-current control of a semiconductor light source.

Semiconductor light source driving apparatus 10 shown in FIG. 1 is a constant current driving circuit using a current control loop. Output current detecting circuit 14 that detects the current applied to this semiconductor light source 12, is provided at one end of single semiconductor light source 12 or at one end of a plurality of semiconductor light sources 12 connected in series. In order to let a constant current be applied to semiconductor light source 12, the output of output current detecting circuit 14 is sent to current comparing circuit 16 and is compared with a current command value from current command section 18. Output voltage controlling circuit 20 performs a pulse width control in voltage source 26 according to the comparison result in current comparing circuit 16. To be more specific, voltage source 26 is constituted by: power supply source 28 such as a battery; DC-DC converter 30 of a drop-switching or boost-switching scheme for performing a DC-DC conversion of direct current power from power supply source 28; and smoothing circuit 32 such as an LC (i.e. an inductor and capacitor). Output voltage controlling circuit 20 controls DC-DC converter 30 according to the comparison result in current comparing circuit 16. The output voltage of DC-DC converter 30 is converted into a desired DC voltage value in smoothing circuit 32 and is supplied to semiconductor light source 12. In this way, negative feedback closed loop current control CL1 is performed. Further, output voltage controlling circuit 20 is constituted by proportional gain circuit 22 and compensating circuit 24.

With negative feedback closed loop CL1 constituted in this way, when the value of the current that is applied to semiconductor light source 12 is greater than the desired current value, a pulse-shaped square wave voltage of a short on-period is supplied to the gate of the switching element in DC-DC converter 30, so that the smoothed voltage that is supplied to semiconductor light source 12 decreases and the current of semiconductor light source 12 decreases. By contrast with this, when the value of the current that is applied to semiconductor light source 12 is lower than the desired current value, a pulse-shaped square wave voltage of a long on-period is supplied to the gate of the switching element, so that the smoothed voltage that is supplied to semiconductor light source 12 increases and the current of semiconductor light source 12 increases. By means of such a negative feedback closed loop current control, a desirable constant current that makes the output value of output current detecting circuit 14 the same as the current command value, is applied to semiconductor light source 12, thereby creating a stable state in semiconductor light source 12.

However, in conventional semiconductor light source driving apparatus 10 shown in FIG. 1, when a fluctuation occurs in control loop CL1 due to voltage fluctuations between power supply source 28 and DC-DC converter 30, noise from outside and disturbance noise entering output current detecting circuit 14, the constant-current control becomes unstable. Therefore, there is a technical limit that the response speed (i.e. frequency characteristics) and gain of closed loop CL1 cannot be increased very much. Accordingly, conventional semiconductor light source driving apparatus 10 may be best employed for goods such as mobile telephones that can function well enough as a backlight device by applying a fixed constant current to semiconductor light source 12 on a regular basis. However, conventional semiconductor light source driving apparatus 10 may not be best employed for goods that change the desired constant current value frequently, for example, goods of fields requiring the function of adjusting light to change the brightness of the light source.

Therefore, Patent Literature 1 proposes semiconductor light source driving apparatus 40 shown in FIG. 2. This semiconductor light source driving apparatus 40 with an addition of control loop CL2, is designed to drive semiconductor light source 12 by a constant current and to reduce heat generated in the circuit element group including semiconductor light source 12 by optimizing the voltage that is supplied to semiconductor light source 12, thereby making a backlight device light stably while light is adjusted.

As a specific configuration, in this semiconductor light source driving apparatus 40, as shown in FIG. 2, DC-DC converter 30, output driving element 42, voltage comparing circuit 44 and output voltage controlling circuit 20 form first negative feedback closed loop CL1 for controlling the supply voltage, and output driving element 42 and constant current controlling circuit 46 form second negative feedback closed loop CL2 for controlling the constant current. Output driving element 42 is a transistor or FET, for example. Further, with this configuration, the voltage generated across resistor (R) 48 connected in series with semiconductor light source 12, is detected and used for the control loops of both negative feedback closed loops CL1 and CL2. The value of this voltage is proportional to the drive current of semiconductor light source 12, and, consequently, negative feedback closed loops CL1 and CL2 form a two-fold current control loop. Generally, when a feedback loop is two-fold, interference is produced between the loops and the operation of the loops becomes unstable. Therefore, this configuration sets the frequency response characteristics of one loop (i.e. closed loop CL1) to a one-twentieth of the frequency response characteristics of the other loop (i.e. closed loop CL2), to prevent interference between the loops.

CITATION LIST

Patent Literature

PTL 1: Japanese Patent Application Laid-Open No. 2007-042758

SUMMARY

Technical Problem

However, with the technique disclosed in Patent Literature 1, the response upon stable operation depends on the response of the slower control loop, and, therefore, the response upon light adjustment depends on the response of the slower control loop.

Further, first of all, there is a problem that it is difficult for both semiconductor light source driving apparatus 10 shown in FIG. 1 and semiconductor light source driving apparatus 40 shown in FIG. 2 to stabilize driving while light is adjusted, due to the electrical characteristics of the semiconductor light sources.

First, the electrical characteristics of the semiconductor light sources (such as LD's and LED's) will be explained.

Seen from the driving side, a semiconductor light source has electrical characteristics that equal the characteristics of a diode. An example of the well-known voltage-current characteristics of a diode is shown in FIG. 3A. That is, when a voltage is applied, little current flows until the voltage generally referred to as a "threshold" and a current starts flowing slowly after the voltage exceeds the threshold. Afterwards, the ratio of the increase in the current with respect to the increase in the voltage becomes higher, so that the current increases abruptly even when the voltage changes a little. To view this from another point of view, as shown in FIG. 3B, the impedance of a diode decreases following the increase in the applied voltage. Further, assuming that a diode is a functional element that receives a voltage as input and outputs a current, as shown in FIG. 3C, its gain is not constant with respect to the input voltage and increases following the increase in the input voltage. A semiconductor light source inherently has such characteristics.

Accordingly, in constant-current control according to a conventional control loop, it is difficult to maintain constant control characteristics because the control loop round trip gain ("control loop gain" or simply "loop gain") changes depending on the value of the voltage that is applied to an element. That is, it is difficult with conventional constant-current control to adjust light of a semiconductor light source stably.

Next, control characteristics of a semiconductor light source (such as LD and LED) will be explained.

Here, by modeling the current control system shown in FIG. 1, the control characteristics of a semiconductor light source in conventional constant-current control will be explained using this model.

FIG. 4 is a block diagram obtained by modeling semiconductor light source driving apparatus 10 shown in FIG. 1.

When a voltage is supplied to semiconductor light source 12 from voltage source 26, a drive current that match the characteristics of semiconductor light source 12 is applied to semiconductor light source 12 and so this drive current is used as an output of semiconductor light source 12. This drive current is detected by output current detecting circuit 14. This detection result is outputted to current comparing circuit 16 and is subtracted from the current command value to find the difference. Output voltage controlling circuit 20 multiplies this difference by a certain gain to control voltage source 26. According to such a control loop, the output current from semiconductor light source 12 is controlled to match with the current command value.

The gain that makes a round trip in this control loop is a control loop round trip gain (hereinafter "control loop gain"). Here, the gain of voltage source 26 and the gain of output current detecting circuit 14 are both constants. In case where output voltage control circuit 20 performs a proportional control, the gain of output voltage controlling circuit 20 becomes a constant. As described above, semiconductor light source 12 has the gain characteristics as shown in FIG. 3C. Consequently, the control loop gain becomes proportional to the gain characteristic in FIG. 3C and changes according to the drive current value in semiconductor light source 12.

Accordingly, if the control loop gain is optimized where the drive current value is small, the gain of semiconductor light source 12 becomes high where the drive current value is great, and the control loop gain becomes higher than an optimal value, thereby causing overshoot, ringing and oscillation in the rising edges. By contrast with this, if the control loop gain is optimized where the drive current value is great, the gain of semiconductor light source 12 becomes low where the drive current value is small and the control loop gain becomes lower than the optimal value, thereby making its response poor.

That is to say, seen from the power supply side, the impedance of a semiconductor light source generally changes according to the drive current value. When the drive current value is small, the terminal voltage increases following the increase in the drive current value, so that the semiconductor light source has a practically constant impedance. By contrast with this, when the drive current value becomes great to some extent, even though the drive current value increases, the change in the terminal voltage becomes smaller, so that the impedance becomes smaller. Accordingly, in an area where the drive current value is great to some extent, even a little change in the drive voltage leads to a significant change in the drive current value. When a current controlling apparatus having a current control loop performs a constant-current control of a semiconductor light source with such electrical characteristics, the control loop gain changes depending on whether the drive current value is great or small, thereby changing current control performance.

In this way, with conventional semiconductor light source driving apparatuses, there is a problem that, due to the electrical characteristics of the semiconductor light source, the control loop gain changes depending on whether the drive current value is great or small, thereby changing current control performance. Consequently, there is a demand for a semiconductor light source driving apparatus that can achieve constant control performance regardless of whether the drive current value is great or small, that is, for a semiconductor light source driving apparatus that can automatically adjust the characteristics of the current control loop to an optimal value, when the drive current value is increased or decreased while light is adjusted to change the brightness of the semiconductor light source.

The object is to provide a semiconductor light source driving apparatus and semiconductor light source driving method that can achieve constant control performance regardless of whether the drive current value is great or small when a drive current value is increased and decreased while light is adjusted.

Solution to Problem

To achieve the above object, the semiconductor light source driving apparatus employs a configuration which includes: a semiconductor light source that is driven by a current; a voltage source that drives the semiconductor light source; an output voltage controlling section that controls a drive current value for driving the semiconductor light source by controlling an output voltage of the voltage source; an output current detecting section that detects an output current of the semiconductor light source; a current command section that specifies a reference value of a drive current which is applied to the semiconductor light source; a current comparing section that compares the output current detected by the output current detecting section and the reference value specified by the current command section; and an impedance detecting section that detects an impedance of the semiconductor light source, and in which the output voltage controlling section controls the output voltage of the voltage source based on an output of the current comparing section and an output of the impedance detecting section.

Further, the semiconductor light source driving method in a semiconductor light source driving apparatus that includes: a semiconductor light source that is driven by a current; a voltage source that drives the semiconductor light source; and an output voltage controlling section that controls a drive current value for driving the semiconductor light source by controlling an output voltage of the voltage source, includes: detecting an output current of the semiconductor light source; comparing the detected output current of the semiconductor light source and a specified reference value; detecting an impedance of the semiconductor light source; and controlling the output voltage of the voltage source based on a result of the comparison and the impedance of the semiconductor light source.

Advantageous Effects

The semiconductor light source driving apparatus and semiconductor light source driving method according to the present invention can achieve constant control performance regardless of whether a drive current value is great or small when the drive current value is increased and decreased while light is adjusted.

DESCRIPTION OF EMBODIMENTS

An embodiment of the present invention will be explained in detail below with reference to the accompanying drawings.

Figure 5:
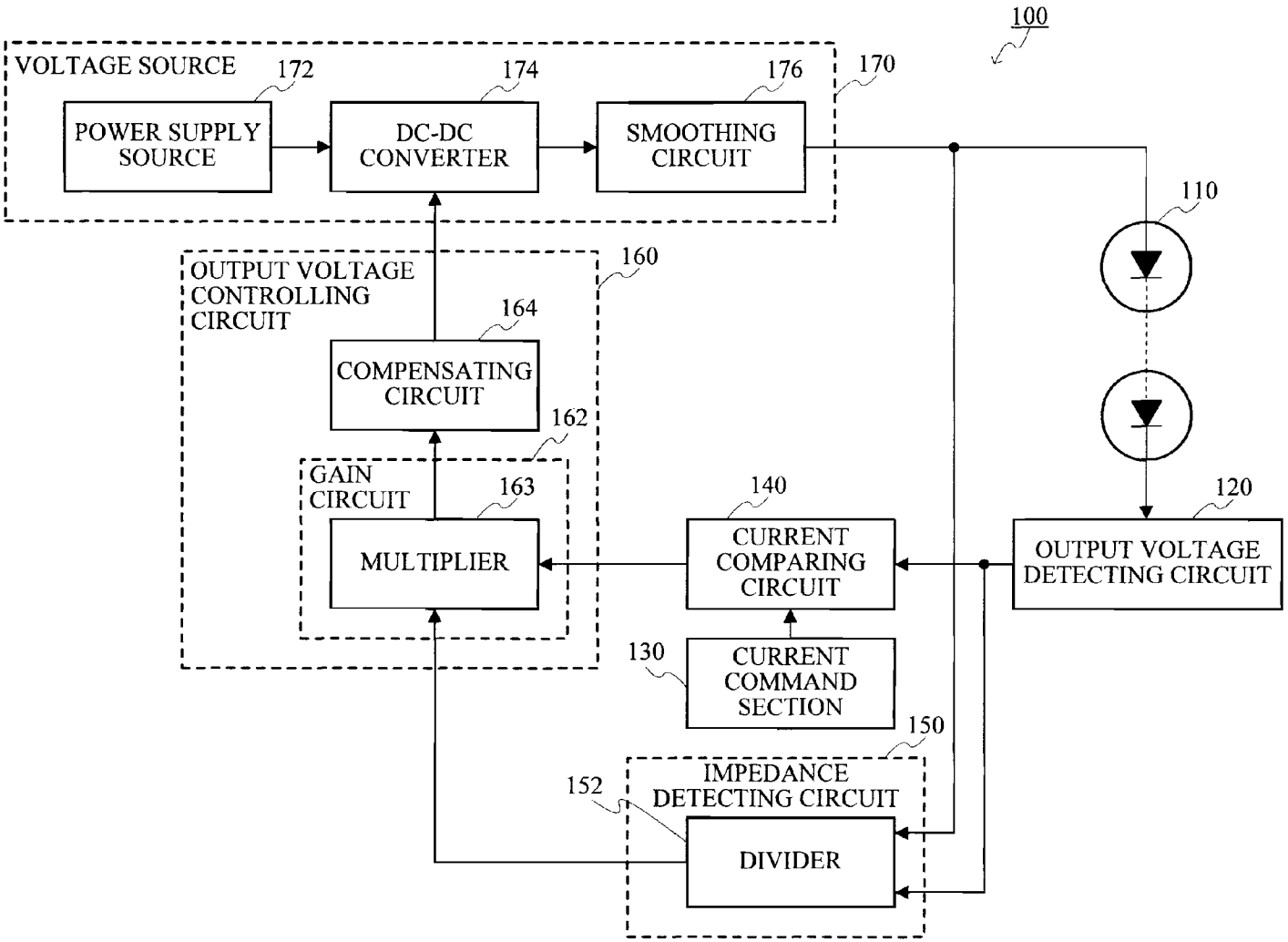
FIG. 5 is a block diagram showing a configuration of a semiconductor light source driving apparatus according to an embodiment of the present invention.

FIG. 5 is a block diagram showing a configuration of a semiconductor light source driving apparatus according to an embodiment of the present invention.

Semiconductor light source driving apparatus 100 shown in FIG. 5 generally has semiconductor light source 110, output current detecting circuit 120, current command section 130, current comparing circuit 140, impedance detecting circuit 150, output voltage controlling circuit 160 and voltage source 170. Impedance detecting circuit 150 is constituted by divider 152. Output voltage controlling circuit 160 is constituted by gain circuit 162 and compensating circuit 164 and, further, gain circuit 162 is constituted by multiplier 163. Voltage source 170 is constituted by power supply source 172, DC-DC converter 174 and smoothing circuit 176. In comparison with conventional semiconductor light source driving apparatus 10 shown in FIG. 1, the characteristic components of semiconductor light source driving apparatus 100 according to the present embodiment are impedance detecting circuit 150 and gain circuit 162 of output voltage controlling circuit 160.

Semiconductor light source 110 is constituted by a single semiconductor light source (such as LD and LED) or a plurality of semiconductor light sources connected in series. To be more specific, semiconductor light source 110 is constituted by, for example, a single LD or LED, or by a plurality of LD's or LED's connected in series. Semiconductor light source 110 is driven by a current.

Figure 3A:
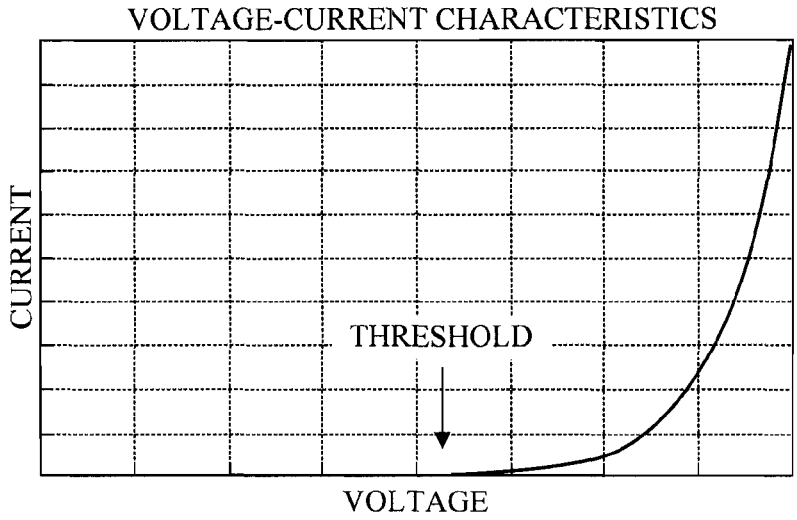
FIG. 3A shows an example of voltage-current characteristics of a semiconductor light source.
Figure 3B:
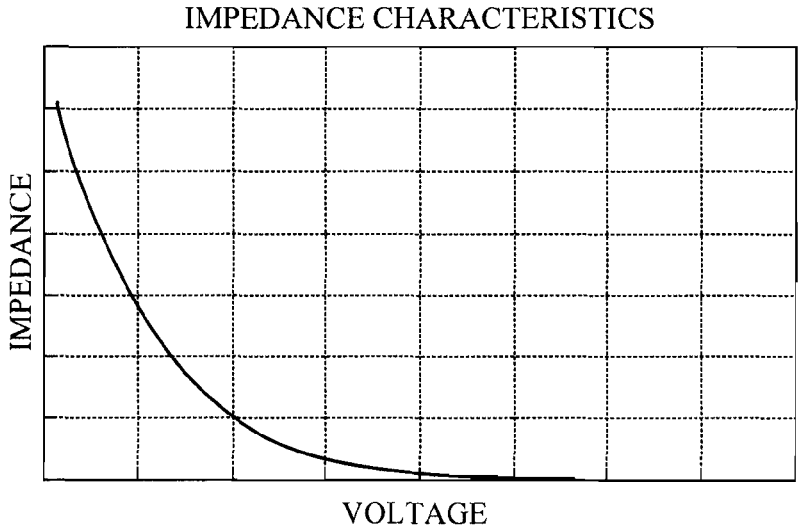
FIG. 3B shows an example of impedance characteristics of the semiconductor light source.
Figure 3C:
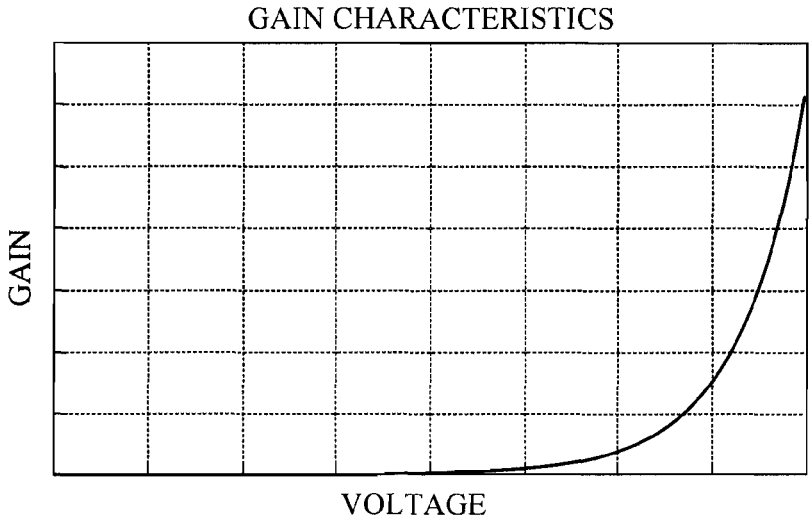
FIG. 3C shows an example of gain characteristics of the semiconductor light source.
Figure 4:
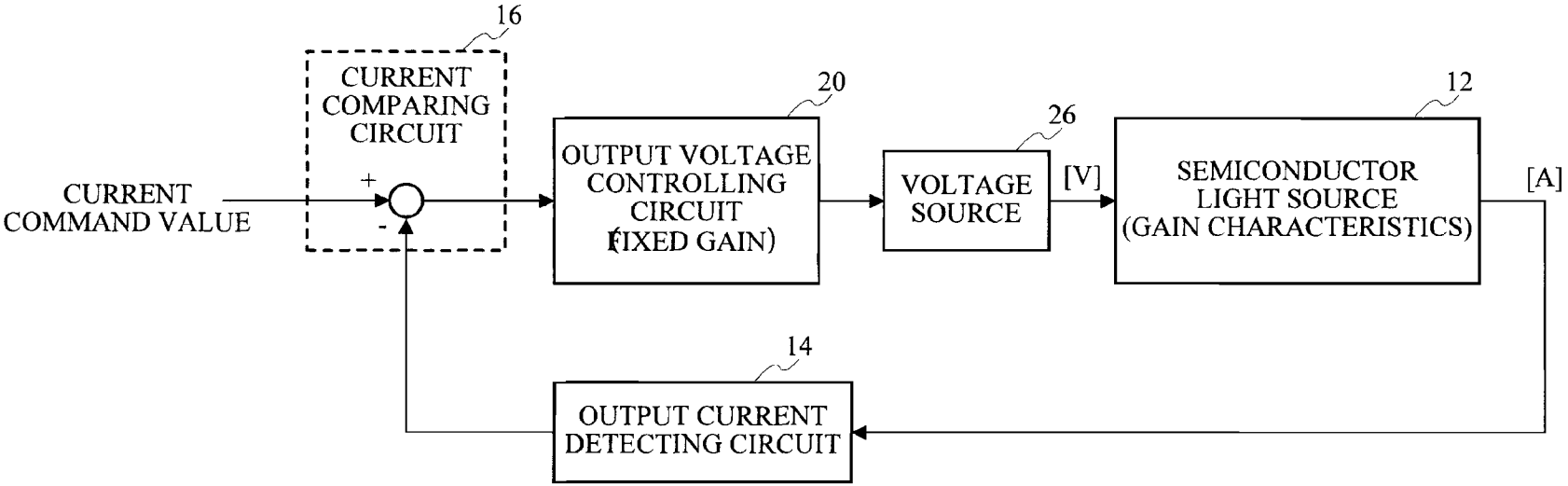
FIG. 4 is a block diagram obtained by modeling the semiconductor light source driving apparatus in FIG. 1.

When a drive voltage is supplied to semiconductor light source 110 from voltage source 170, a certain drive current is applied to semiconductor light source 110. An example of characteristics of the drive current with respect to the drive voltage at this time is as shown in above FIG. 3A. As described above, semiconductor light source 110 has characteristics where, although little current is applied to semiconductor light source 110 when the voltage is equal to or less than the voltage value generally referred to as the "threshold," the current value increases abruptly when the voltage value becomes equal to or greater than the threshold. Viewing these characteristics from a different point of view, above FIG. 3B shows a change in the impedance with respect to the voltage value. As shown in FIG. 3B, impedance decreases abruptly following the increase of the drive voltage. Further, in case where the ratio of the drive current (i.e. output) with respect to the drive voltage (i.e. input) is gain, above FIG. 3C shows changes in gain with respect to the drive voltage. As shown in FIG. 3C, gain increases abruptly following the increase in the drive voltage.

Figure 2:
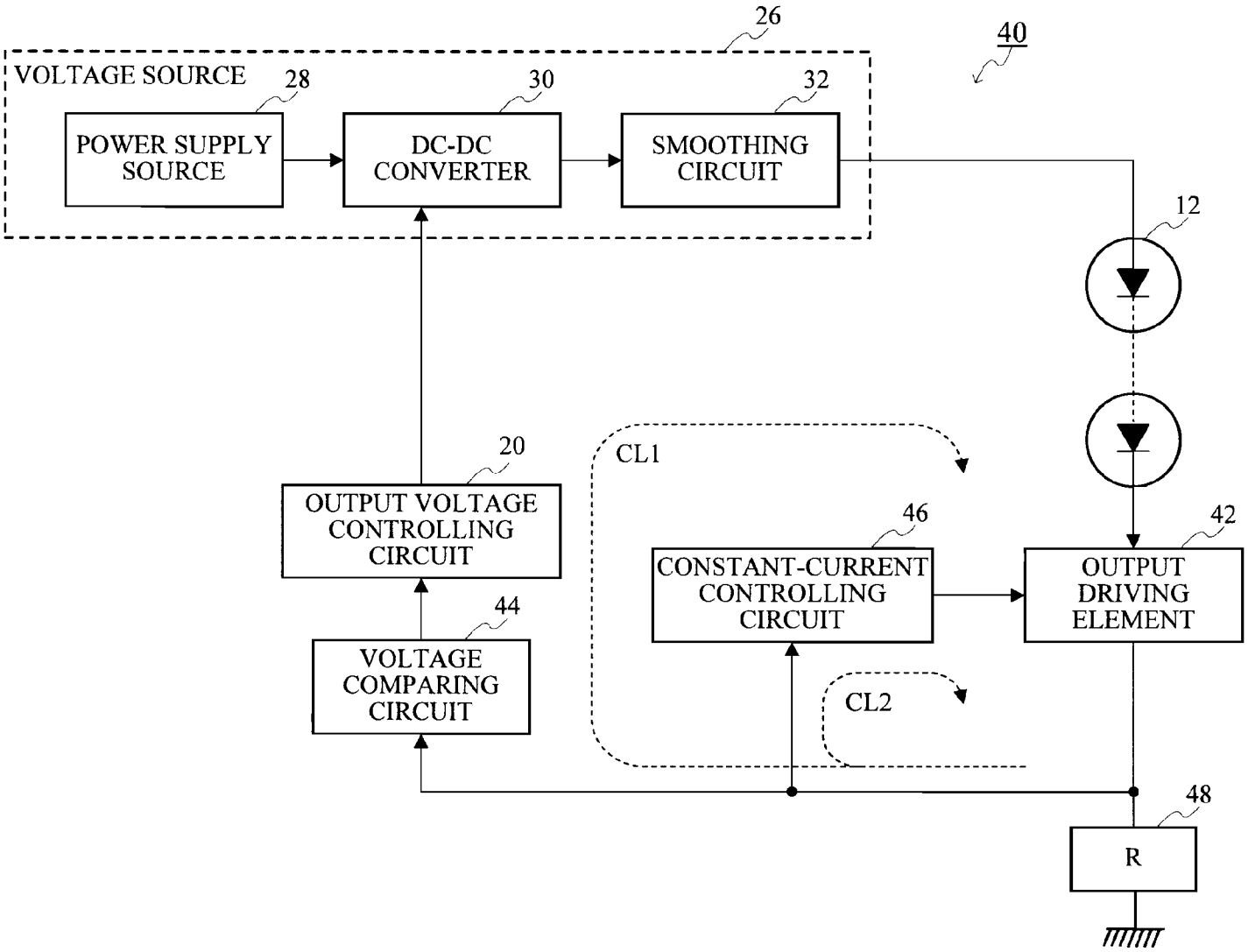
FIG. 2 is a block diagram showing another configuration example of a conventional semiconductor light source driving apparatus.

Output current detecting circuit 120 detects the drive current (i.e. output current) that is applied to semiconductor light source 110. The output current detecting circuit may employ a method of detecting the voltage generated across a resister (see FIG. 2) or a non-contact scheme using a Hall element.

Current command section 130 sets (i.e. specifies) a reference value (i.e. current command value) of the drive current that is applied to semiconductor light source 110. The current command value is set by the operation by the user or set automatically by a computer. Light of semiconductor light source 110 is adjusted according to this current command value. The current control loop operates such that the output current value detected by output current detecting circuit 120 matches with this current command value.

Current comparing circuit 140 compares the output current value detected by output current detecting circuit 120 and the reference value (i.e. current command value) set by current command section 130, to find the difference between the output current value and the reference value. This comparison result (i.e. difference) is outputted to multiplier 163 in gain circuit 162 of output voltage controlling circuit 160. The current control loop operates such that the output of this current comparing circuit 140 becomes zero.

Impedance detecting circuit 150 is one of characteristic components of the present invention and detects the impedance of semiconductor light source 110. With the present embodiment, impedance detecting circuit 150 is constituted by divider 152. Divider 152 finds the impedance of semiconductor light source 110 (strictly speaking, a value corresponding to the impedance of semiconductor light source 110, hereinafter "impedance equivalent value") by diving the output voltage of voltage source 170 supplied to semiconductor light source 110 by the output current of semiconductor light source 110 detected by output current detecting circuit 120. By this means, it is possible to find an impedance equivalent value which corresponds to the characteristics in FIG. 3B showing the impedance characteristics of semiconductor light source 110, in a state in which semiconductor light source 110 is actually driven.

Output voltage controlling circuit 160 controls the drive current value for driving semiconductor light source 110, by controlling the output voltage of voltage source 170. With the present embodiment, output voltage controlling circuit 160 is constituted by gain circuit 162 and compensating circuit 164. Further, gain circuit 162 is constituted by multiplier 163.

Gain circuit 162 multiplies, at multiplier 163, the output of current comparing circuit 140 (i.e. the difference between the current command value and the drive current detecting value of semiconductor light source 110), by the impedance equivalent value of semiconductor light source 110 detected by impedance detecting circuit 150. By this means, gain circuit 162 of output voltage controlling circuit 160 has gain characteristics proportional to the impedance characteristics of semiconductor light source 110. That is, gain circuit 162 multiplies the output of current comparing circuit 140 and the impedance equivalent value of semiconductor light source 110 detected by impedance detecting circuit 150, to prevent the gain of the control loop from changing even when the impedance of semiconductor light source 110 changes, that is, automatically adjusts the characteristics of the current control loop, to the optimal value according to the detected impedance equivalent value. Gain circuit 162 is one of the characteristic components of the present invention.

Figure 1:
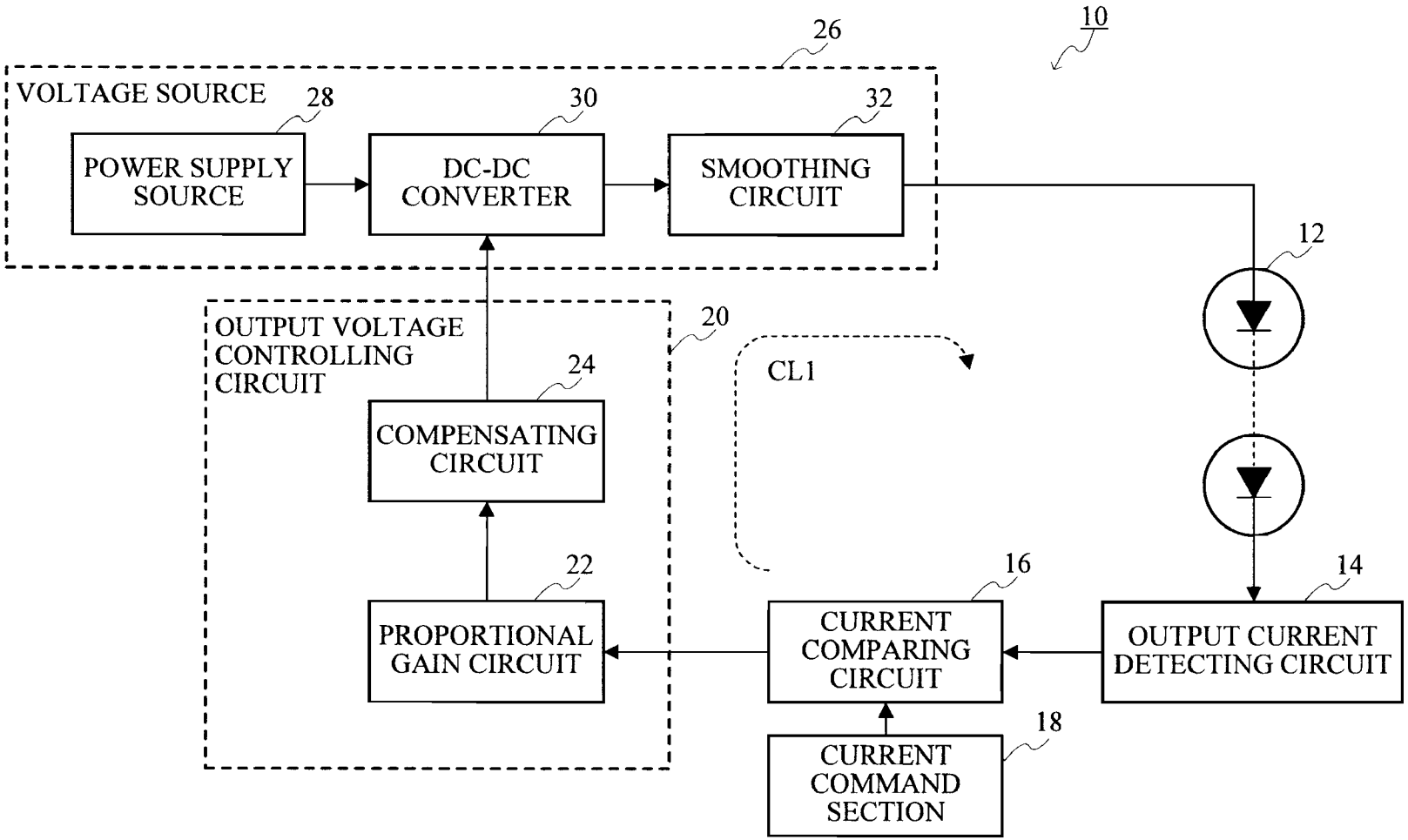
FIG. 1 is a block diagram showing a configuration example of a conventional semiconductor light source driving apparatus.

Further, in comparison with a conventional technique shown in FIG. 1, gain circuit 162 according to the present invention corresponds to proportional gain circuit 22. However, a fixed gain is multiplied in proportional gain circuit 22 and output voltage controlling circuit 20 maintains constant gain characteristics regardless of changes in the impedance of semiconductor light source 12.

Compensating circuit 164 is a circuit that compensates for control characteristics, to be more specific, a circuit that performs phase compensation for the output of gain circuit 162. Phase compensation is processing to stabilize the phase of a waveform, that is, to keep a phase shift within a certain range. This phase compensation is generally performed to stabilize the feedback control. The output of this compensating circuit 164 is applied to voltage source 170 as the output of output voltage controlling circuit 160, and, by this means, the output voltage of voltage source 170 is controlled.

Voltage source 170 drives semiconductor light source 110. Voltage source 170 is constituted by power supply source 172 such as a battery, DC-DC converter 174 of a drop-switching or boost-switching scheme for performing a DC-DC conversion of direct current power from power supply source 172 and smoothing circuit 176 such as an LC (i.e. inductor and capacitor).

To be more specific, voltage source 170 receives the output of output voltage controlling circuit 160 and outputs a voltage matching this output, to semiconductor light source 110. Voltage source 170 may employ a series regulator scheme of discharging voltage drop as Juele heat or a DC-DC converter scheme using a switching element. In case of the series regulator scheme, a voltage controlling element controls the output voltage and generates an output voltage proportional to the output of output voltage controlling circuit 160. In case of the DC-DC converter scheme, voltage source 170 generates a pulse of a duty cycle proportional to the output of output voltage controlling circuit 160 and smoothes this pulse through smoothing circuit 176, thereby generating an output voltage proportional to the output of output voltage controlling circuit 160 as in the series regulator scheme. Of these schemes, the DC-DC converter scheme can reduce power loss and therefore is more efficient. Accordingly, with the present embodiment, voltage source 170 is configured based on the DC-DC converter scheme.

Further, with the present embodiment, the control loop is constituted by semiconductor light source 110, output current detecting circuit 120, current comparing circuit 140, output voltage controlling circuit 160 and voltage source 170.

Next, the principle of the operation of semiconductor light source driving apparatus 100 having the above configuration will be explained.

Figure 6:
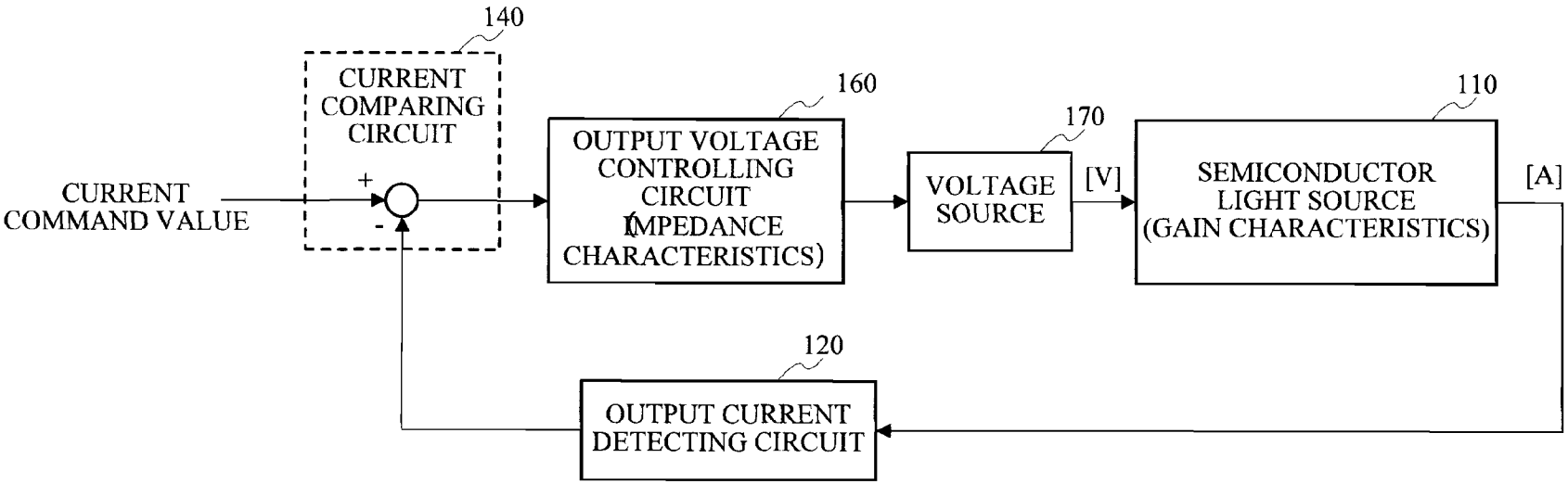
FIG. 6 is a block diagram showing a configuration of the control system in the semiconductor light source driving apparatus in FIG. 5.

FIG. 6 is a block diagram showing the configuration of the control system of semiconductor light source driving apparatus 100 in FIG. 5. As described above, the components in FIG. 6, including semiconductor light source 110, output current detecting circuit 120, current comparing circuit 140, output voltage controlling circuit 160 and voltage source 170, constitute a control loop.

As described above, the gain characteristics of semiconductor light source 110 show the characteristics shown in FIG. 3C. Further, gain circuit 162 of output voltage controlling circuit 160, which multiplies the output of current comparing circuit 140 by the impedance equivalent value of semiconductor light source 110 detected by impedance detecting circuit 150 in FIG. 5, has characteristics including gain characteristics proportional to the impedance characteristics of semiconductor light source 110 shown in FIG. 3B. Consequently, referring to the block diagram of FIG. 6, output voltage controlling circuit 160 has the impedance characteristics (FIG. 3B) of semiconductor light source 110, and, in output voltage controlling circuit 160, these impedance characteristics and the gain characteristics (FIG. 3C) of semiconductor light source 110 are multiplied. The gain characteristics of semiconductor light source 110 and the impedance characteristics are reciprocals with respect to each other, and, when they are multiplied, the multiplication result becomes a constant value. That is, the non-linear gain characteristics of semiconductor light source 110 are cancelled by the characteristics of output voltage controlling circuit 160. As a result, this control loop serves as a normal, linear control loop in which characteristics are not changed by the value of the drive current that is applied to semiconductor light source 110, and can maintain constant control characteristics regardless of the drive current value. That is, the control loop round trip gain of the control system in FIG. 6 becomes constant regardless of the drive current of semiconductor light source 110. Then, when the control loop round trip gain can be made constant, it is possible to adjust light stably regardless of the drive current value.

This will be explained in detail as follows.

Figure 7:
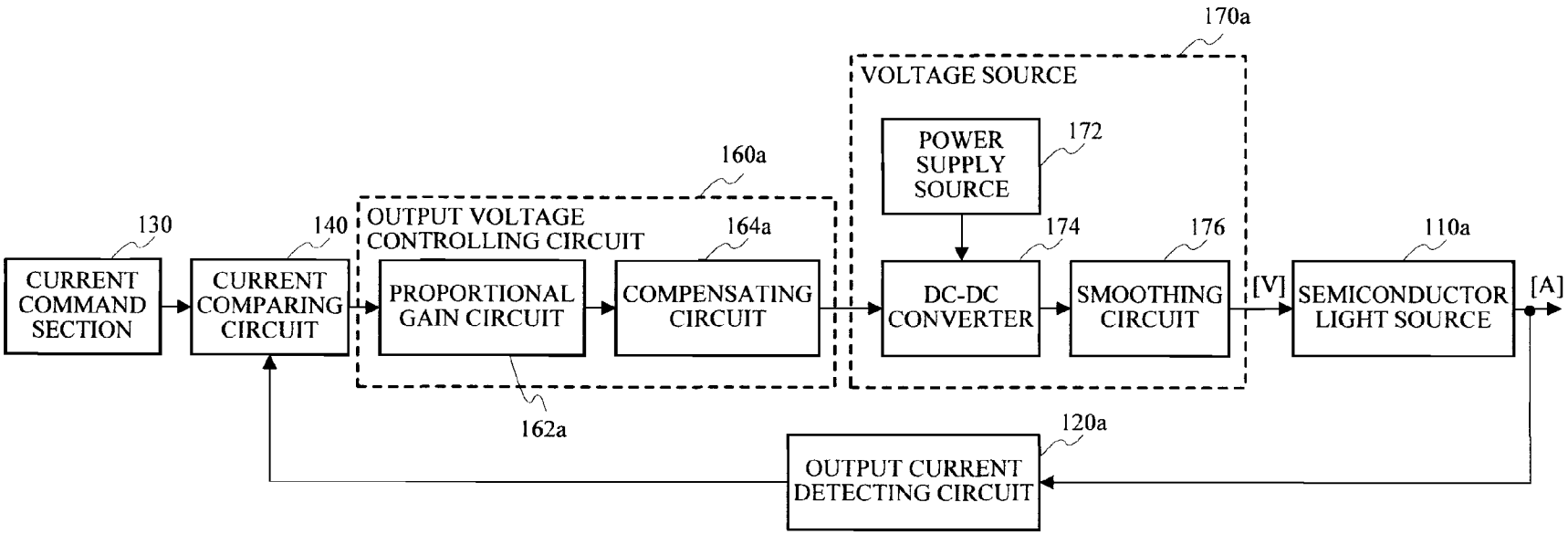
FIG. 7 is a block diagram in which part of the configuration of the semiconductor light source driving apparatus in FIG. 5 is redrawn.

FIG. 7 is a block diagram in which part of the configuration of semiconductor light source driving apparatus 100 in FIG. 5 is redrawn. Here, in this drawing, the components of semiconductor light source driving apparatus 100 in FIG. 5 (except impedance detecting circuit 150) are arranged to communicate signals from the left to the right, according to the way the block diagram of the feedback control system is drawn.

In FIG. 7, using, for example, proportional gain circuit 162*a* and compensating circuit 164*a*, output voltage controlling circuit 160*a* performs a proportional integral (PI) control comprised of general proportional gain multiplication and integral compensation. At this time, the proportional gain is represented as "$K_p$" and the integral time constant for the integral compensation is represented as "$T_i$." Further, although voltage source 170*a* uses DC-DC converter 174 here, assuming that a voltage is specified and voltage source 170*a* outputs the voltage, the first order lag approximation is applied to voltage source 170*a*. At this time, as to the voltage outputted in response to the specified voltage, the gain with a first order lag is represented as "$K_v$" and the time constant is represented as "$T_v$." Further, assuming that output current detecting circuit 120*a* is fast enough in response to the response of voltage source 170*a* and does not have the frequency characteristics for ease of explanation, the gain is represented as "$K_s$." Further, assume that semiconductor light source 110*a* is represented as a component that receives a voltage as input and outputs a current and, therefore, the gain produced by converting the voltage into the current is represented as "gm" and, even here, semiconductor light source 110*a* does not have the frequency characteristics for ease of explanation.

Figure 8:
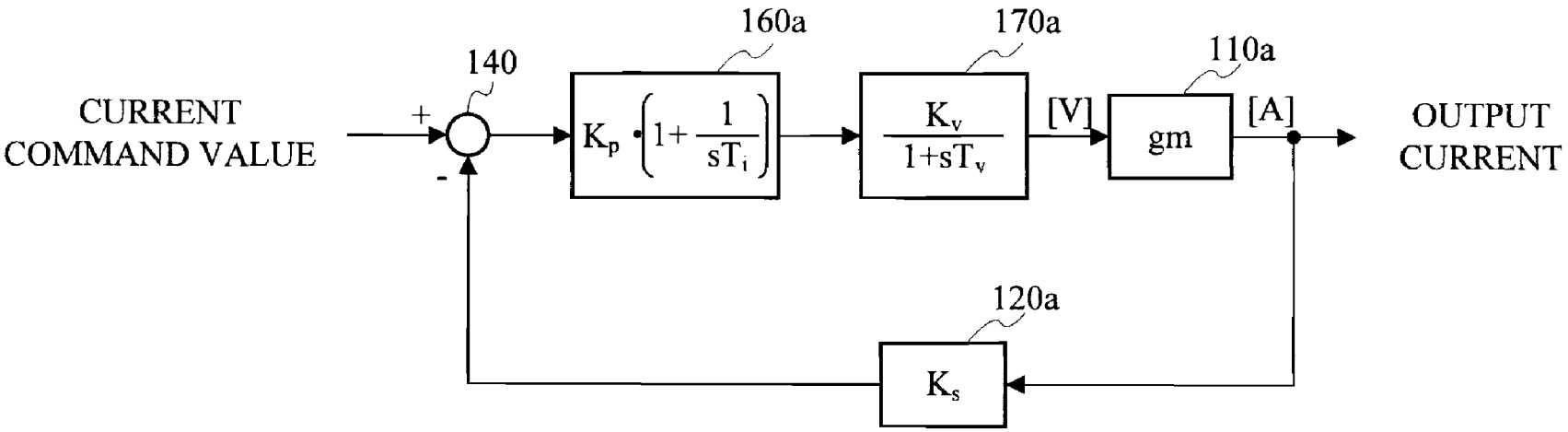
FIG. 8 is a block diagram in which the configuration of the control system in FIG. 7 is redrawn.

FIG. 8 is a block diagram in which the configuration of the control system in FIG. 7 is redrawn using these symbols. In FIG. 8, "s" is a Laplace operator.

Here, the following equation 1 is derived by finding the transfer function G(s) from the current command value to the output current in this control system using the block diagram of FIG. 8.

(Equation 1)

$$G(s) = \frac{K_p \cdot \left(1 + \frac{1}{sT_i}\right) \cdot \left(\frac{K_v}{1 + sT_v}\right) \cdot gm}{1 + K_p \cdot \left(1 + \frac{1}{sT_i}\right) \cdot \left(\frac{K_v}{1 + sT_v}\right) \cdot gm \cdot K_s} \quad [1]$$

Then, the following equation 2 can be derived by rearranging this equation 1.

(Equation 2)

$$G(s) = \frac{\alpha \cdot s + \beta}{s^2 + \left(\frac{1}{Tv} + \alpha \cdot Ks\right) \cdot s + \beta \cdot Ks} \quad [2]$$

$$\alpha = \frac{K_p \cdot K_v \cdot gm}{T_v}$$

$$\beta = \frac{K_p \cdot K_v \cdot gm}{T_v \cdot T_i}$$

Figure 9A:
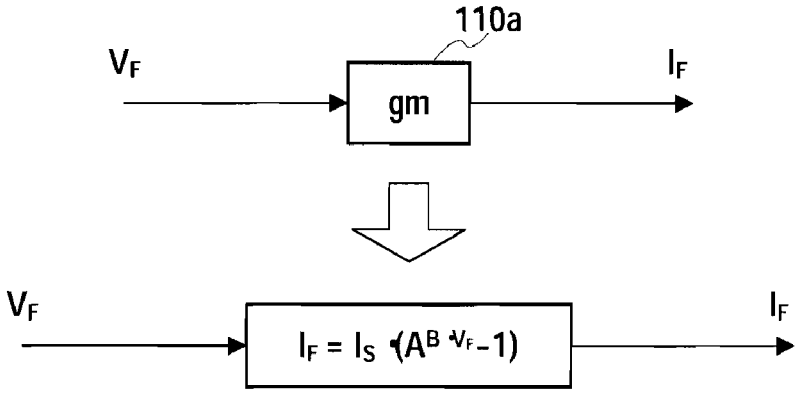
FIG. 9A shows an approximated equation of the semiconductor light source in FIG. 8.

Further, assuming that the drive voltage supplied to semiconductor light source 110*a* is represented as "$V_F$" and the drive current that is applied to semiconductor light source 110*a* is represented as "$I_F$," when the drive voltage $V_F$ is a variable, an approximated equation of the drive current $I_F$ is derived as shown in FIG. 9A. Here, A is a fixed constant, B is a coefficient related to temperature and $I_S$ is the reverse saturation current.

Figure 9B:
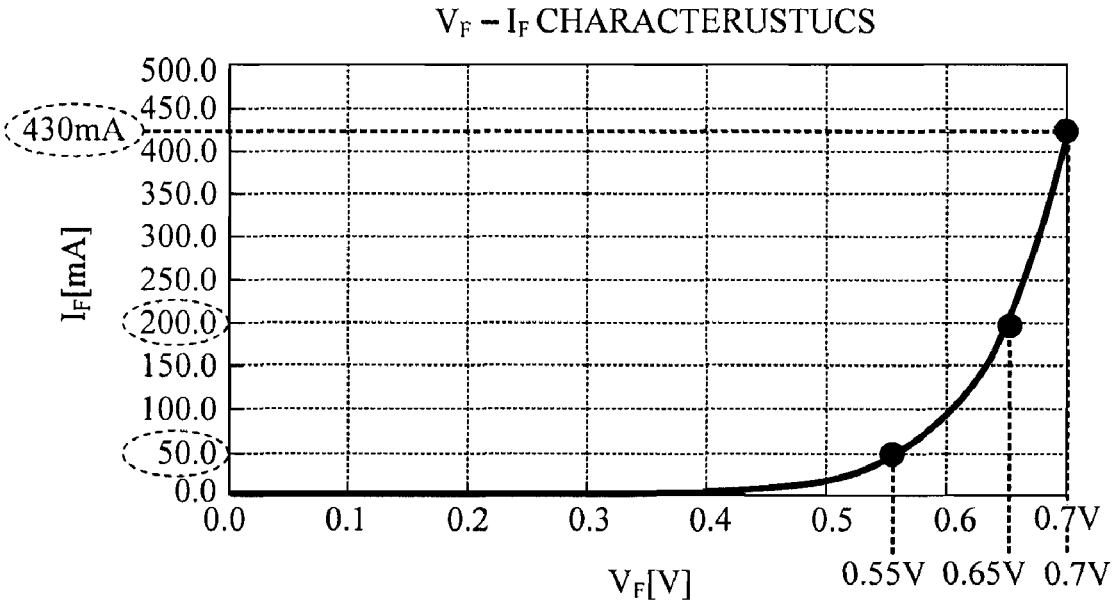
FIG. 9B shows an example of approximated characteristics of the semiconductor light source in FIG. 8 by graphing an approximated equation of the semiconductor light source shown in FIG. 9A.

FIG. 9B shows an example of graphing an approximated equation of semiconductor light source 110*a* shown in FIG. 9A and calculating gains gm in three points. Here, $I_S$=10[μA], A=2.72 and B=15.23[1/V]. Further, the gains gm are derived from gm=$I_F/V_F$ based on the drive voltage $V_F$ and the drive current $I_F$.

As shown in FIG. 9B, as to the gains gm in three points, when ($V_F$, $I_F$)=(0.55V, 0.05 A), gm=0.091 A/V, when ($V_F$, $I_F$)=(0.65V, 0.20 A), gm=0.308 A/V, and, when ($V_F$, $I_F$)=(0.70V, 0.43 A), gm=0.614 A/V. This shows that values of gains gm change depending on the drive voltage $V_F$ (i.e. drive current $I_F$).

Further, the frequency transfer function G(jω) in the following equation 3 can be acquired by rewriting "s" of the transfer function G(s) in equation 2 by "jω"

(Equation 3)

$$G(j\omega) = \frac{\beta + \alpha \cdot j\omega}{\beta \cdot Ks - \omega^2 + \left(\frac{1}{Tv} + \alpha \cdot Ks\right) \cdot j\omega} \quad [3]$$

$$\alpha = \frac{K_p \cdot K_v \cdot gm}{T_v}$$

$$\beta = \frac{K_p \cdot K_v \cdot gm}{T_v \cdot T_i}$$

Figure 10:
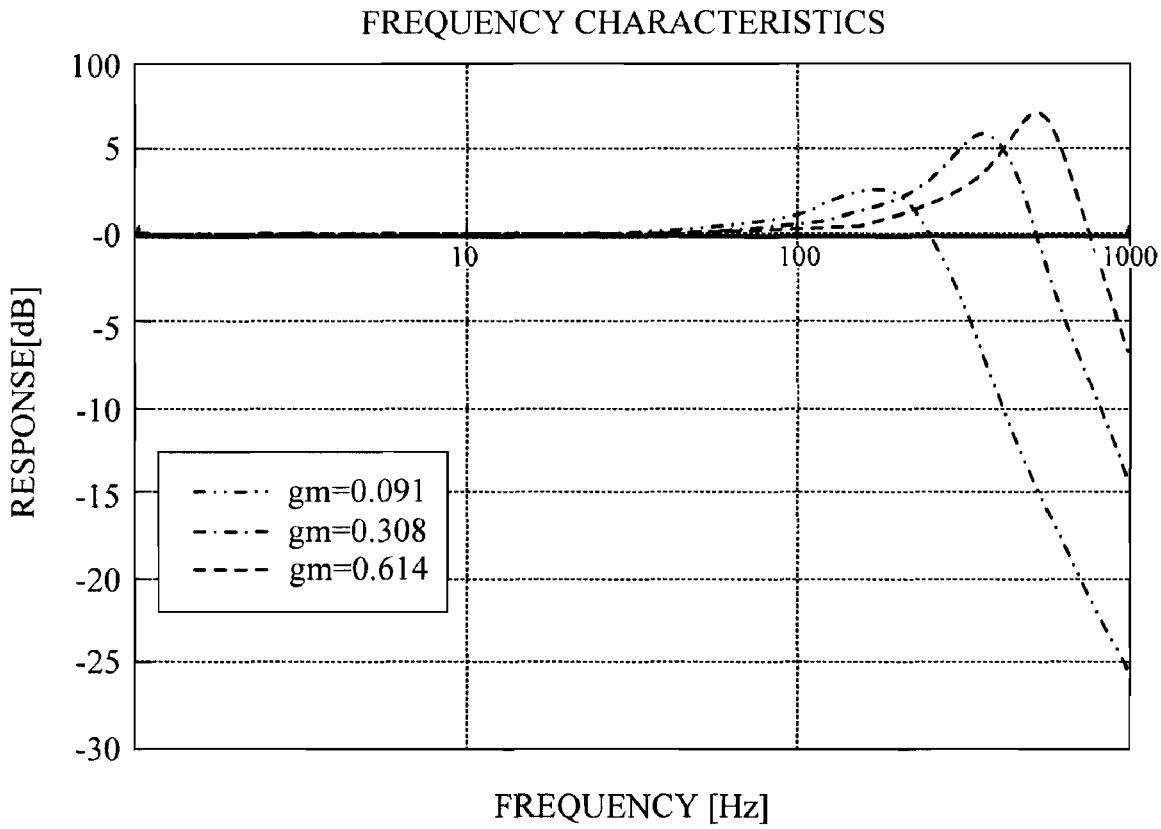
FIG. 10 shows a result of calculating the frequency characteristics of the three gains gm shown in FIG. 9B based on the frequency transfer function.

FIG. 10 shows results of calculating frequency characteristics of three gains gm shown in FIG. 9B according to the frequency transfer function G(jω) in equation 3. Here, for ease of explanation, assume that $K_v$=1, $T_v$=1[ms], $T_i$=0.5 [ms] and $K_p$=1. FIG. 10 shows that the frequency characteristics of the gains gm change in the vicinity of the cutoff frequency. Here, supposing that the frequency characteristics are good and stable in case of the smallest gain gm of 0.091, gains become greater near the cutoff frequency as the gains gm become greater. From this, in case where, for example, the current command value shows a square wave pulse, overshoot/undershoot and ringing are produced in the rising edges/trailing edges, and the frequency characteristics enter an unstable area.

Therefore, semiconductor light source driving apparatus 100 according to the present embodiment employs, as described above, a configuration for detecting the drive voltage and drive current of semiconductor light source 110 to find the impedance and multiplying the value of this impedance by a proportional gain.

Figure 11:
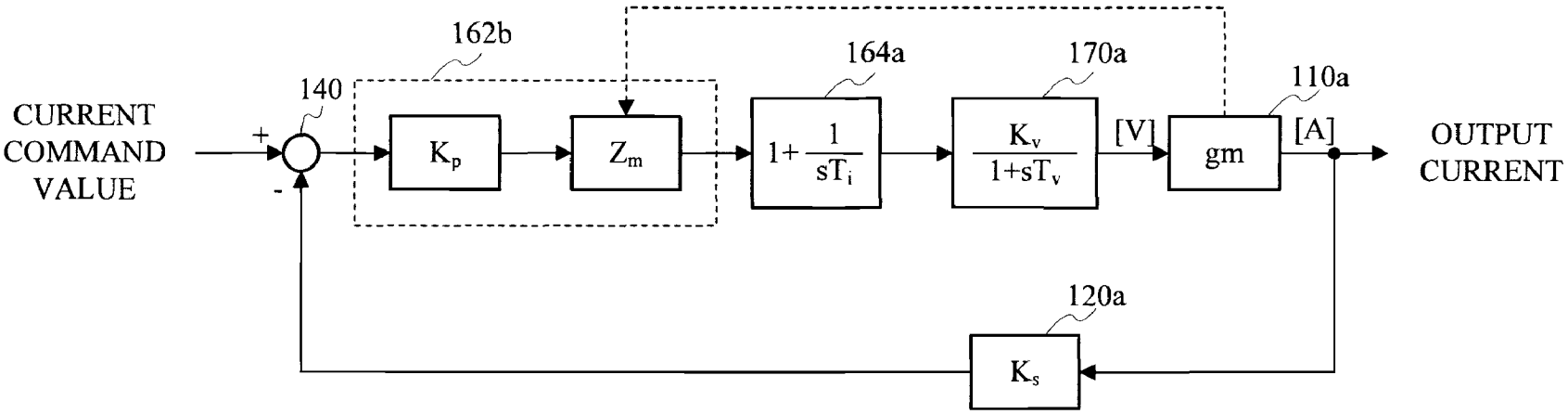
FIG. 11 is a block diagram showing a configuration of the control system in the semiconductor light source driving apparatus in FIG. 5.

FIG. 11 is a block diagram showing a configuration of the control system in semiconductor light source driving apparatus 100 in FIG. 5 and corresponds to FIG. 8. Here, the configuration of FIG. 11 differs from the configuration of FIG. 8 in that the element of $Z_m$=1/gm is inserted between the proportional gain (i.e. proportional gain circuit 162*a*) and the integral compensation (i.e. compensating circuit 164*a*). That is, with the configuration of FIG. 11, the output of impedance detecting circuit 150 in FIG. 5 is fed back to gain circuit 162*b*.

As described above, the difference between FIG. 11 and FIG. 8 is that the element of $Z_m$=1/gm is inserted between the proportional gain and integral compensation. Gain gm is the conductance of semiconductor light source 110*a*, and, consequently, 1/gm is the impedance of semiconductor light source 110*a*. Modeling the configuration of detecting the drive voltage and drive current of semiconductor light source 111*a* to find the impedance and multiplying the proportional gain by the value of this impedance, show this configuration of FIG. 11 where $Z_m$ is inserted.

The following equation 4 can be derived by finding the transfer function G(s) from the current command value to the output current in this control system using the block diagram in FIG. 11.

(Equation 4)

$$G(s) = \frac{K_p \cdot Z_m \cdot \left(1 + \frac{1}{sT_i}\right) \cdot \left(\frac{K_v}{1 + sT_v}\right) \cdot g/m}{1 + K_p \cdot Z_m \cdot \left(1 + \frac{1}{sT_i}\right) \cdot \left(\frac{K_v}{1 + sT_v}\right) \cdot g/m \cdot K_s} \quad [4]$$

At this time, $Z_m$=1/gm, and, consequently, $Z_m$×gm=1 holds. Accordingly, equation 4 can be represented as equation 5 by rearranging this equation 4 using $Z_m$×gm=1.

(Equation 5)

$$G(s) = \frac{\alpha \cdot s + \beta}{s^2 + \left(\frac{1}{Tv} + \alpha \cdot Ks\right) \cdot s + \beta \cdot Ks} \quad [5]$$

$$\alpha = \frac{K_p \cdot K_v}{T_v}$$

$$\beta = \frac{K_p \cdot K_v}{T_v \cdot T_i}$$

Accordingly, as is clear from this equation 5, equation 5 has no relationship with gm, so that it is possible to make the characteristics of the transfer function G(s) constant regardless of the drive voltage and drive current of semiconductor light source 110*a*.

In this way, according to the present embodiment, impedance detecting circuit 150 is provided to feed back the output of impedance detecting circuit 150 to gain circuit 162 to prevent the gain of a control loop from changing even when the impedance of semiconductor light source 110 changes, so that it is possible to make a control loop round trip gain constant regardless of whether the drive current value is great or small, that is, it is possible to automatically adjust the characteristics of the current control loop, to an optimal value. Consequently, it is possible to solve a problem in stabilization of driving while light is adjusted, due to the electrical characteristics of a semiconductor light source, and achieve constant control performance regardless of whether a drive current value is great or small when the drive current value is increased or decreased while light is adjusted. That is, in an apparatus that drives a semiconductor light source by a current, when a drive current value is increased or decreased while light is adjusted to change the brightness of the semiconductor light source, it is possible to achieve constant control performance regardless of whether the drive current value is great or small and perform the operation of adjusting light stably.

INDUSTRIAL APPLICABILITY

The semiconductor light source driving apparatus and semiconductor light source driving method according to the present invention can make driving stable even while light is adjusted and, consequently, are useful as a semiconductor light source driving apparatus and semiconductor light source driving method that, when a drive current value is increased or decreased while light is adjusted, can achieve constant control performance regardless of whether the drive current value is great or small.

REFERENCE SIGNS LIST

100 semiconductor light source driving apparatus
110 and 110*a* semiconductor light source
120 and 120*a* output current detecting circuit
130 current command section
140 current comparing circuit
150 impedance detecting circuit
152 divider
160 and 160*a* output voltage controlling circuit
162 and 162*b* gain circuit
162*a* proportional gain circuit
163 multiplier
164 and 164*a* compensating circuit
170 and 170*a* voltage source
172 power supply source
174 DC-DC converter
176 smoothing circuit

The invention claimed is:

1. A semiconductor light source driving apparatus comprising:

a semiconductor light source that is driven by a current;

a voltage source that drives the semiconductor light source;

an output voltage controlling section that controls a drive current value for driving the semiconductor light source by controlling an output voltage of the voltage source;

an output current detecting section that detects an output current of the semiconductor light source;

a current command section that specifies a reference value of a drive current which is applied to the semiconductor light source;

a current comparing section that compares the output current detected by the output current detecting section and the reference value specified by the current command section; and an impedance detecting section that detects an impedance of the semiconductor light source, wherein the output voltage controlling section controls the output voltage of the voltage source based on an output of the current comparing section and an output of the impedance detecting section.

2. The semiconductor light source driving apparatus according to claim 1, wherein the impedance detecting section comprises a divider that divides the output voltage of the voltage source by the output current detected by the output current detecting section, and acquires a value corresponding to the impedance of the semiconductor light source from an output of the divider.

3. The semiconductor light source driving apparatus according to claim 1, wherein:

the output voltage controlling section comprises a gain circuit that sets a gain; and the gain circuit multiplies the impedance of the semiconductor light source detected by the impedance detecting section and the output of the current comparing section to prevent a gain of a control loop from changing even when the impedance of the semiconductor light source changes.

4. The semiconductor light source driving apparatus according to claim 1, wherein the output voltage controlling section comprises:

a multiplier that multiplies the impedance of the semiconductor light source detected by the impedance detecting section and the output of the current comparing section; and a compensator that performs predetermined processing with respect to an output of the multiplier to compensate for control characteristics.

5. A semiconductor light source driving method in a semiconductor light source driving apparatus that comprises:

a semiconductor light source that is driven by a current;

a voltage source that drives the semiconductor light source; and an output voltage controlling section that controls a drive current value for driving the semiconductor light source by controlling an output voltage of the voltage source, the semiconductor light source driving method comprising:

detecting an output current of the semiconductor light source;

comparing the detected output current of the semiconductor light source and a specified reference value;

detecting an impedance of the semiconductor light source; and controlling the output voltage of the voltage source based on a result of the comparison and the impedance of the semiconductor light source.

* * * * *